US006395132B1

(12) United States Patent
Doelle et al.

(10) Patent No.: US 6,395,132 B1
(45) Date of Patent: May 28, 2002

(54) WASHING SYSTEM AND WASHER FOR A FIBER SUSPENSION

(75) Inventors: Klaus Doelle; Kurt W. Lorenz; Robert J. Matz, all of Appleton, WI (US)

(73) Assignee: Voith Sulzer Paper Technology North America, Inc., Appleton, WI (US)

( * ) Notice: Subject to any disclaimer, the term of this patent is extended or adjusted under 35 U.S.C. 154(b) by 0 days.

(21) Appl. No.: 09/512,662

(22) Filed: Feb. 24, 2000

(51) Int. Cl.[7] ..... D21C 9/02
(52) U.S. Cl. ..... 162/60; 162/380; 210/400
(58) Field of Search ..... 162/4, 41, 42, 162/43, 44, 45, 55, 59, 60, 61, 198, 199, 189, 264, 380; 210/400, 401; 8/156; 68/9, 13 R

(56) References Cited

U.S. PATENT DOCUMENTS

| | | | | |
|---|---|---|---|---|
| 4,466,873 A | * | 8/1984 | Bolton et al. | 162/198 |
| 4,936,118 A | * | 6/1990 | Sbaschnigg et al. | 68/9 |
| 5,367,894 A | * | 11/1994 | Parks et al. | 68/22 R |
| 5,378,322 A | * | 1/1995 | Hornsey | 162/158 |
| 5,466,335 A | * | 11/1995 | Parks | 162/60 |
| 5,482,594 A | * | 1/1996 | Slaminen | 162/60 |
| 5,591,336 A | * | 1/1997 | Seifert et al. | 210/386 |
| 5,599,426 A | | 2/1997 | Hoffman | 162/60 |
| 5,996,604 A | | 12/1999 | Doelle et al. | 137/1 |

* cited by examiner

*Primary Examiner*—Peter Chin
*Assistant Examiner*—Eric Hug
(74) *Attorney, Agent, or Firm*—Taylor & Aust, P.C.

(57) ABSTRACT

A washing system for washing a fiber suspension associated with a fiber stock preparation system, includes a plurality of rolls and a porous fabric carried by the plurality of rolls in a closed loop. The closed loop includes a lower run defining a washing zone, with the porous fabric moving in a running direction through the washing zone. The porous fabric has an upper surface in the washing zone which carries the fiber suspension thereon. A headbox is positioned with the closed loop and above the porous fabric at an upstream end of the washing zone. The headbox discharges a fiber suspension to be washed onto the upper surface of the porous fabric. An accept removal device is positioned within the closed loop and above the porous fabric at a downstream end of the washing zone. A plurality of showers, each having an inlet, are positioned within the closed loop and above the porous fabric in the washing zone between the headbox and accept removal device. A plurality of dewatering elements are positioned below the fabric in the washing zone. Each dewatering elements is configured for removing water from a bottom surface of the porous fabric. An effluent tank has a plurality of compartments, with each compartment having an inlet and an outlet. At least one outlet of the effluent tank is connected with a corresponding shower inlet. A plurality of drainage pans are positioned below the lower run of the porous fabric. Each drainage pan is associated with at least one dewatering element and has an outlet. Each drainage pan outlet is connected with a corresponding effluent tank inlet.

23 Claims, 4 Drawing Sheets

WASHING SYSTEM AND WASHER FOR A FIBER SUSPENSION

BACKGROUND OF THE INVENTION

1. Field of the Invention

The present invention relates to a washer for washing pulp, such as paper pulp, and, more particularly, to a washer in a fiber stock preparation system.

2. Description of the Related Art

Pulp, such as paper pulp, may be suspended in water and transported to a paper-making machine for the manufacture of a paper web. The pulp suspension is usually treated in various ways prior to being transported to the paper-making machine, such as by bleaching and washing of bleach and other chemicals from the suspension.

A fiber stock preparation system is used to prepare the fiber stock or fiber suspension which is used in the paper-making machine for the production of a fiber web such as paper. A pulp washer is used to wash effluents from the fiber suspension in the paper-making machine. A fiber suspension with a predetermined consistency is transported into the washer where effluents in the fiber suspension are typically separated from the fiber suspension through drainage via gravitational force and centrifugal forces. The fiber suspension is normally carried by a wire through the washer. One or more showers which extend across the width of the wire in a direction transverse to the running direction are used to jet a fluid against the fiber suspension which is used to dilute and wash the fiber suspension.

In a washer as described above, multiple showers are typically used to wash the fiber suspension at successive locations along the length of the washer. After the clean water is jetted onto the fiber suspension with each shower, the excess water in the fiber suspension drains through the wire and carries the effluents away from the fiber suspension. It is desirable to remove as much water as possible from the fiber suspension after each shower so that washing of the fiber suspension is maximized. Various structures using centrifugal force, gravitational force and/or pressure are known to dewater the fiber suspension.

What is needed in the art is a washer providing improved washing while occupying less physical space.

SUMMARY OF THE INVENTION

The present invention provides a washing system which effectively washes a fiber suspension and removes effluents therefrom, while at the same time providing a washing system occupying less physical space.

The invention comprises, in one form thereof, a washing system for washing a fiber suspension associated with a fiber stock preparation system, including a plurality of rolls and a porous fabric carried by the plurality of rolls in a closed loop. The closed loop includes a lower run defining a washing zone, with the porous fabric moving in a running direction through the washing zone. The porous fabric has an upper surface in the washing zone which carries the fiber suspension thereon. A headbox is positioned within the closed loop and above the porous fabric at an upstream end of the washing zone. The headbox discharges a fiber suspension to be washed onto the upper surface of the porous fabric. An accept removal device is positioned within the closed loop and above the porous fabric at a downstream end of the washing zone. A plurality of showers, each having an inlet, are positioned within the closed loop and above the porous fabric in the washing zone between the headbox and accept removal device. A plurality of dewatering elements are positioned below the fabric in the washing zone. Each dewatering element is configured for removing water from a bottom surface of the porous fabric. An effluent tank has a plurality of compartments, with each compartment having an inlet and an outlet. At least one outlet of the effluent tank is connected with a corresponding shower inlet. A plurality of drainage pans are positioned below the lower run of the porous fabric. Each drainage pan is associated with at least one dewatering element and has an outlet. Each drainage pan outlet is connected with a corresponding effluent tank inlet.

An advantage of the present invention is that the washing system effectively washes the fiber suspension, while at the same time providing a compact washing system which occupies less physical space.

Another advantage is that the dewatering elements may be configured as table rolls, foils, and/or foil rolls.

BRIEF DESCRIPTION OF THE DRAWINGS

The above-mentioned and other features and advantages of this invention, and the manner of attaining them, will become more apparent and the invention will be better understood by reference to the following description of embodiments of the invention taken in conjunction with the accompanying drawings, wherein.

Figure 1A:
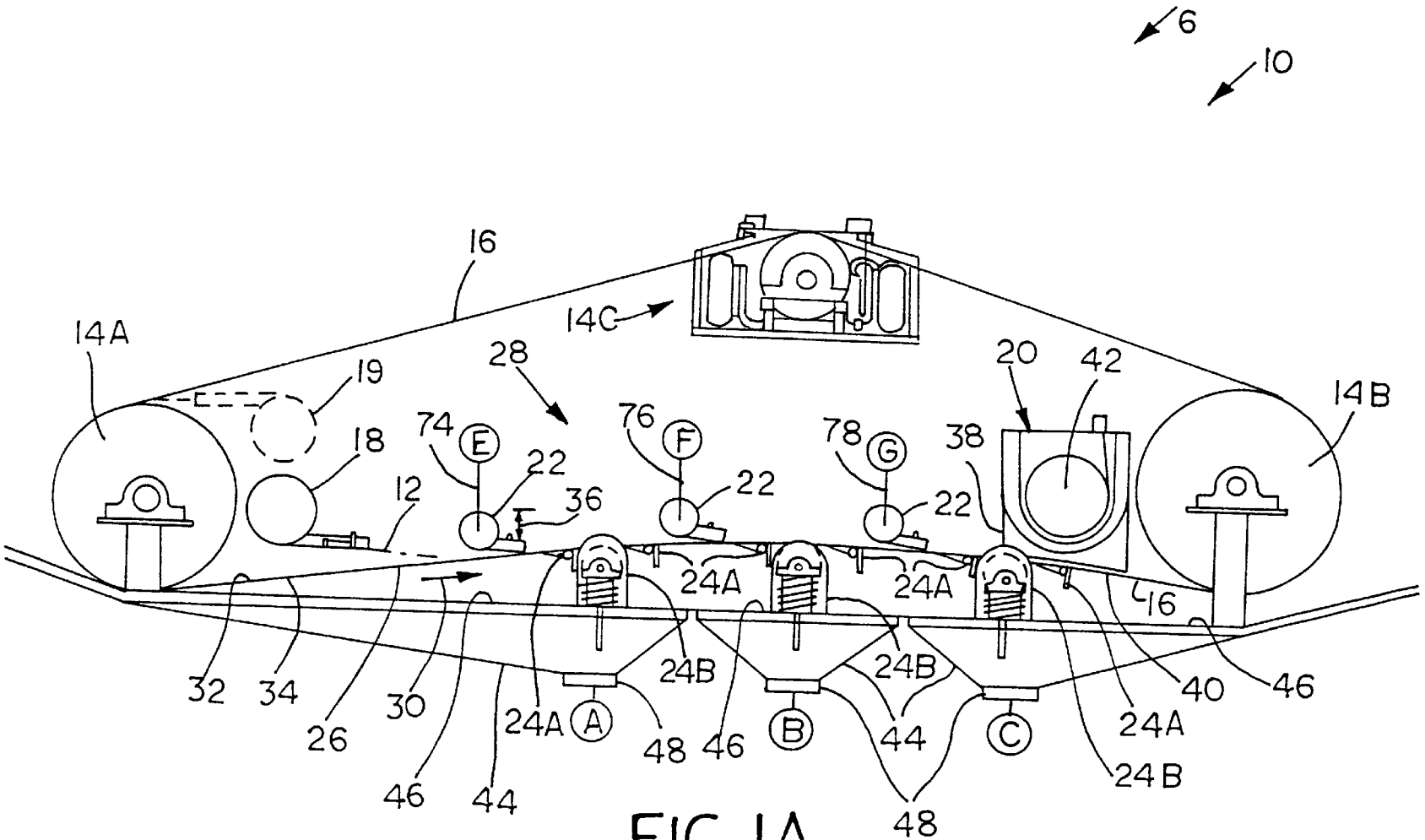
FIGS. 1A and 1B illustrate an embodiment of a washing system of a present invention including a washer and effluent tank.

Corresponding reference characters indicate corresponding parts throughout the several views. The exemplifications set out herein illustrates one preferred embodiment of the invention, in one form, and such exemplifications are not to be construed as limiting the scope of the invention in any manner.

DETAILED DESCRIPTION OF THE INVENTION

Figure 1B:
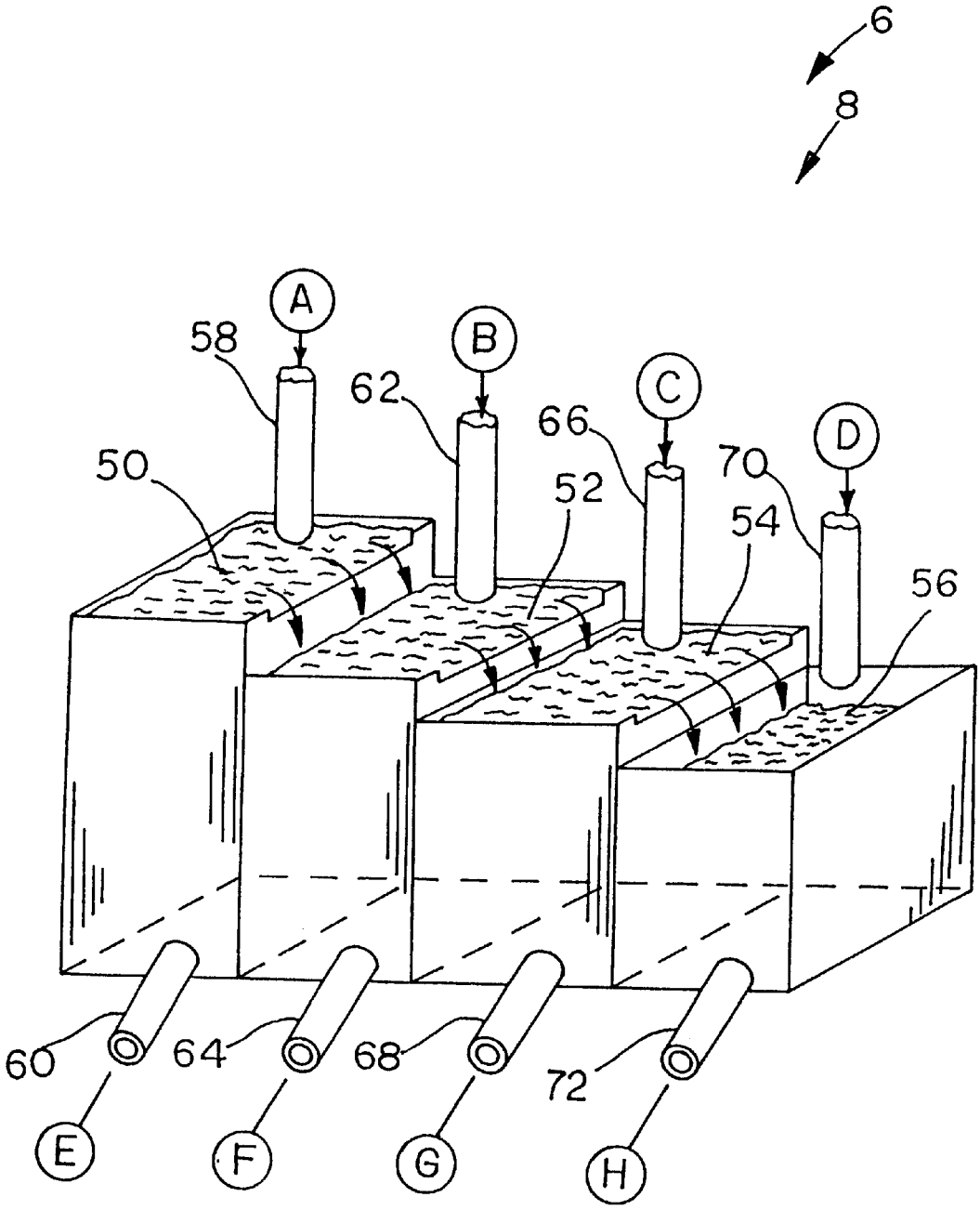

Referring to the drawings, and more particularly to FIGS. 1A and 1B, there is shown an embodiment of a washing system 6 of the present invention, including an effluent tank 8 and a washer 10. Washer 10 is used for washing a fiber suspension 12 associated with a fiber stock preparation system. Washer 10 may either be disposed within the fiber stock preparation system or downstream from the fiber stock preparation system (i.e., between the fiber stock preparation system and paper-making machine).

Fiber suspension 12 is received at washer 10 and includes virgin and/or recycled fibers. A suspension including virgin fiber has chemicals therein which are used to break the pulp down into individual fibers, remove tar from the fibers, etc. A suspension including recycled fibers not only includes chemicals, but also other particulate matter such as stickies, dirt, inks, etc. Washer 10 effectively washes fiber suspension 12, regardless of whether the suspension includes virgin and/or recycled fibers.

Washer 10 generally includes a plurality of rolls 14, porous fabric 16, headbox 18, accept removal device 20, a plurality of showers 22 and a plurality of dewatering elements 24. Porous fabric 16 is constructed to allow the fiber suspension to drain or be drawn therethrough. Porous fabric 16 may be constructed, e.g., as a wire, drilled fabric, etc.

Rolls 14, referenced 14A, 14B, and 14C, carry porous fabric 16. In the embodiment shown, roll 14A is an idle roll, roll 14B is a tension roll which applies a proper tension to porous fabric 16, and roll 14C is a guide roll which guides porous fabric 16. Guide roll 14C may be of any suitable configuration, and in the embodiment shown is constructed as an "E-guide", marketed by the assignee of the present invention and further described in U.S. Pat. No. 5,653,331, entitled "PAPER ROLL GUIDE."

Porous fabric 16 is carried by rolls 14A–14C in a closed loop configuration. The closed loop includes a lower run 26 extending between rolls 14A and 14B which defines a washing zone 28. Porous fabric 16 moves in a running direction 30 through washing zone 28. Porous fabric 16 includes an upper surface 32 and bottom surface 34 within washing zone 28. Upper surface 32 receives fiber suspension 12 to be washed within washing zone 28, and bottom surface 34 is associated with water, chemicals and particulate matter which travels through porous fabric 16.

Headbox 18 is positioned within the closed loop of porous fabric 16 and above porous fabric 16 at upstream end of washing zone 28 (relative to running direction 30). Headbox 18 receives the fiber suspension to be washed within washer 10 from other equipment positioned upstream from washer 10 (e.g. a pulper, etc.). Headbox 18 discharges fiber suspension 12 onto upper surface 32 of porous fabric 16.

An optional second headbox 19 is positioned within the closed loop of porous fabric 16 at an entrance nip defined between porous fabric 16 and roll 14A. Headbox 19 also discharges fiber suspension 12 which is carried on upper surface 32 of porous fabric 16 within washing zone 28.

Showers 22 are positioned within the closed loop of porous fabric 16 and above porous fabric 16 in washing zone 28 at positions between headbox 18 and accept removal device 20. Showers 22 discharge a liquid onto upper surface 32 of porous fabric 16 which is used to wash fiber suspension 12. The liquid may be in the form of clean water, process water and/or white water, as will be described in more details hereinafter. Each shower 22 may be configured with one or more nozzles providing either a fixed or adjustable flow rate. For example, each shower 22 may be configured with one or more nozzles having a fixed or controllably varying cross-section. An example of a shower having nozzles that are adjustable in cross-section is disclosed in copending U.S. patent application Ser. No. 09/216,185 entitled "EFFLUENT SHOWER FOR PULP WASHER", also assigned to assignee of the present invention. In the embodiment shown, each shower 22 has a machine width adjustable nozzle, represented schematically by arrow 36.

Accept removal device 20 is positioned in the closed loop of porous fabric 16 and above porous fabric 16 at a downstream end of washing zone 28, relative to running direction 30. In the embodiment shown, accept removal device 20 includes a box 38 having an open end 40 positioned adjacent to upper surface 32 of porous fabric 16. Box 38 may include suitable scrapers, foils, etc. used to remove fiber suspension 12 from upper surface 32. Box 38 may also optionally be enclosed and a vacuum applied therein. Accept removal device 20 also includes a conveyor in a form of screw conveyor 42 which leads away from box 38 and is used to carry the washed fiber suspension 12 from washer 10. Screw conveyor 42 transports the washed fiber suspension to other equipment located downstream from washer 10, such as a paper making-machine (not shown).

Dewatering elements 24 are positioned below porous fabric 16 in washing zone 28. Each dewatering element 24 is configured for removing water from bottom surface 34 of porous fabric 16. In the embodiment shown, the dewatering elements 24A are in a form of foils, and dewatering elements 24B are in the form of table rolls. Each table roll 24B is positioned downstream from an associated shower 22, relative to running direction 30. In the embodiment shown, a single table roll 24B is positioned downstream from and in association with a corresponding shower 22; however, multiple table rolls 24B may also be positioned in association with each corresponding shower 22.

A plurality of drainage pans 44 are positioned below lower run 26 of porous fabric 16. Each drainage pan 44 is associated with a corresponding table roll 24B, and thus primarily receives water associated with the corresponding table roll 24B. Since the fiber suspension 12 becomes cleaner as it moves toward the downstream end of washing zone 28, drainage pan 44 associated with table roll 24B at the upstream end of washing zone 28 receives dirtier water than does drainage pan 44 associated with table roll 24B at the downstream end of washing zone 28. Each drainage pan 44 includes an open top 46 which receives the water from washing zone 28, and an outlet 48 which provides process water to effluent tank 8, as will be described in more detail hereinafter.

Effluent tank 8 is configured as a flotation-type effluent tank having a plurality of compartments 50, 52, 54 and 56. An example of a similar-type effluent tank is disclosed in U.S. Pat. No. 5,996,604, issued Dec. 7, 1999, and assigned to the assignee of the present invention. More particularly, an inlet 58 and outlet 60 are associated with compartment 50; an inlet 62 and outlet 64 are associated compartment 52; an inlet 66 and outlet 68 are associated with associated with compartment 54; and an inlet 70 and outlet 72 are associated with compartment 56. Inlets 58, 62 and 66 are fluidly connected with outlets 48 of drainage pans 44, and receive process water therefrom as indicated by reference letters A, B and C. In the embodiment shown, the process water associated with reference letter A is at the upstream end of washing zone 28 of washer 10, and thus is dirtier than the process water received at reference letter C associated with the downstream end of washing zone 28. Depending on the particular application, it may also be desirable to configure effluent tank 8 such that inlet 58, 62, 66, and 70 receive sequentially decreasing grades of process water. For example, it may be desirable to fluidly connect inlet 58 with outlet 48 providing cleaner process water from the downstream end of washing zone 28.

Contaminates within the process water received in compartment 50, 52, 54 and 56 are floated to the top using a floatation process. Process water is removed from effluent tank 8 using outlets 60, 64, 68 and 72. Outlet 60 provides the cleanest water, while outlet 72 provides the dirtiest process water. Outlets 60 and 64 are fluidly connected with respective showers 22, as indicated by reference letters E and F. The downstream shower 22 receives fresh or white water, as indicated by reference letter G.

During use, headbox 18 receives the fiber suspension to be washed and discharges fiber suspension 12 onto porous fabric 16 traveling in running direction 30. The fiber suspension 12 which is discharged onto porous fabric 16 is at a consistency of between approximately 0.5 and 3%. Showers 22 discharge process water and/or fresh water onto fiber suspension 12 which decreases the consistency of fiber suspension 12. Foils 24A and one or more table rolls 24B located between each adjacent pair of showers 22 remove excess water from fiber suspension 12, thereby concurrently removing effluents from fiber suspension 12. Each stage of washing (i.e., addition and removal of water associated with each shower 22) is between approximately 0 and 4% consistency change (either positive or negative change), and preferably is between a 0.5 and 4% consistency change. The accept which is removed by accept removal device 20 is between approximately 5 to 12% consistency. As the water is removed from bottom surface 34 of porous fabric 16 traveling through washing zone 28, the water, including effluents carried thereby, drains into each drainage pan 44. Water from outlet 48 associated with each drainage pan 44 is transported to a corresponding compartment 50, 52, or 54 of effluent tank 8, as indicated by reference letter A, B and C, respectively. Stickies and other effluents are floated to the top of each compartment 50–56 and removed. Outlets 60, 64 and 68 are fluidly coupled with inlets 74, 76 and 78 of respective washers 22, and thereby transport re-circulated process water to washers 22. Washer 10 and effluent tank 8 coact to effectively wash fiber suspension 12, while at the same time reducing space requirements necessary for installation and operation of washing system 6.

Figure 2:
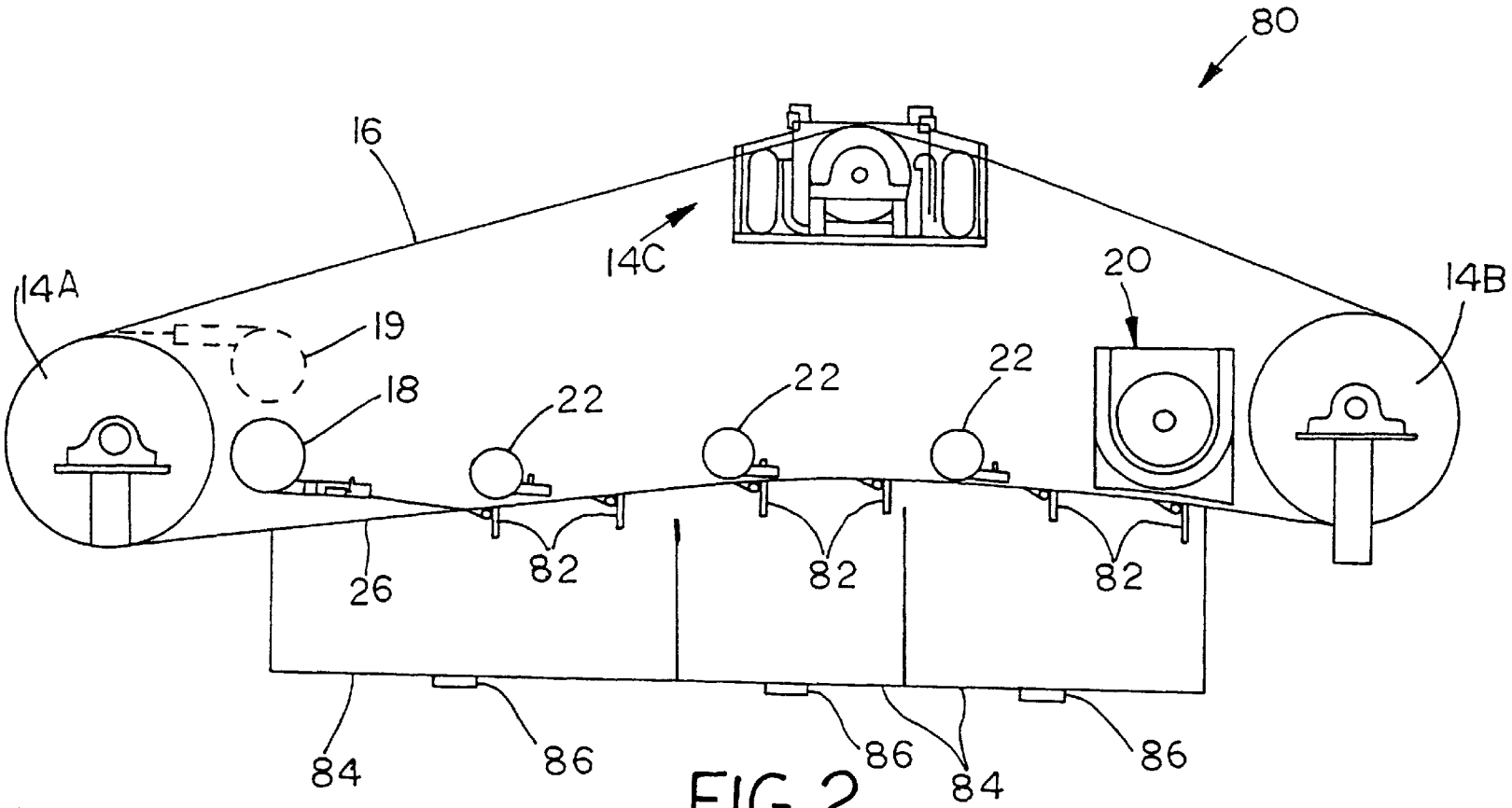
FIG. 2 illustrates another embodiment of a washer of the present invention.

Referring to FIG. 2, there is shown another embodiment of a washer 80 of present invention which may be utilized in conjunction with effluent tank 8 shown in FIG. 1B. The primary distinction between washer 80 shown in FIG. 2 and washer 10 shown in FIG. 1A is in the configuration of the plurality of dewatering elements 82 used to remove water and effluents from bottom surface 34 of porous fabric 16. More particularly, dewatering elements 82 are in the form of a plurality of foils spaced apart along and within washing zone 28. A plurality of drainage pans 84, each having a respective outlet 86, are positioned under porous fabric 16 along the length of washing zone 28. Each drainage pan 84 is positioned in association with one or more foils 82. In the embodiment shown, each drainage pan 84 is positioned in association with two dewatering elements 82. Washer 80 is fluidly coupled with effluent tank 8 the same as described above with reference to washer 8. The operation of washer 80 is substantially the same as described with reference to washer 10, and thus will not be described in further detail.

Figure 3:
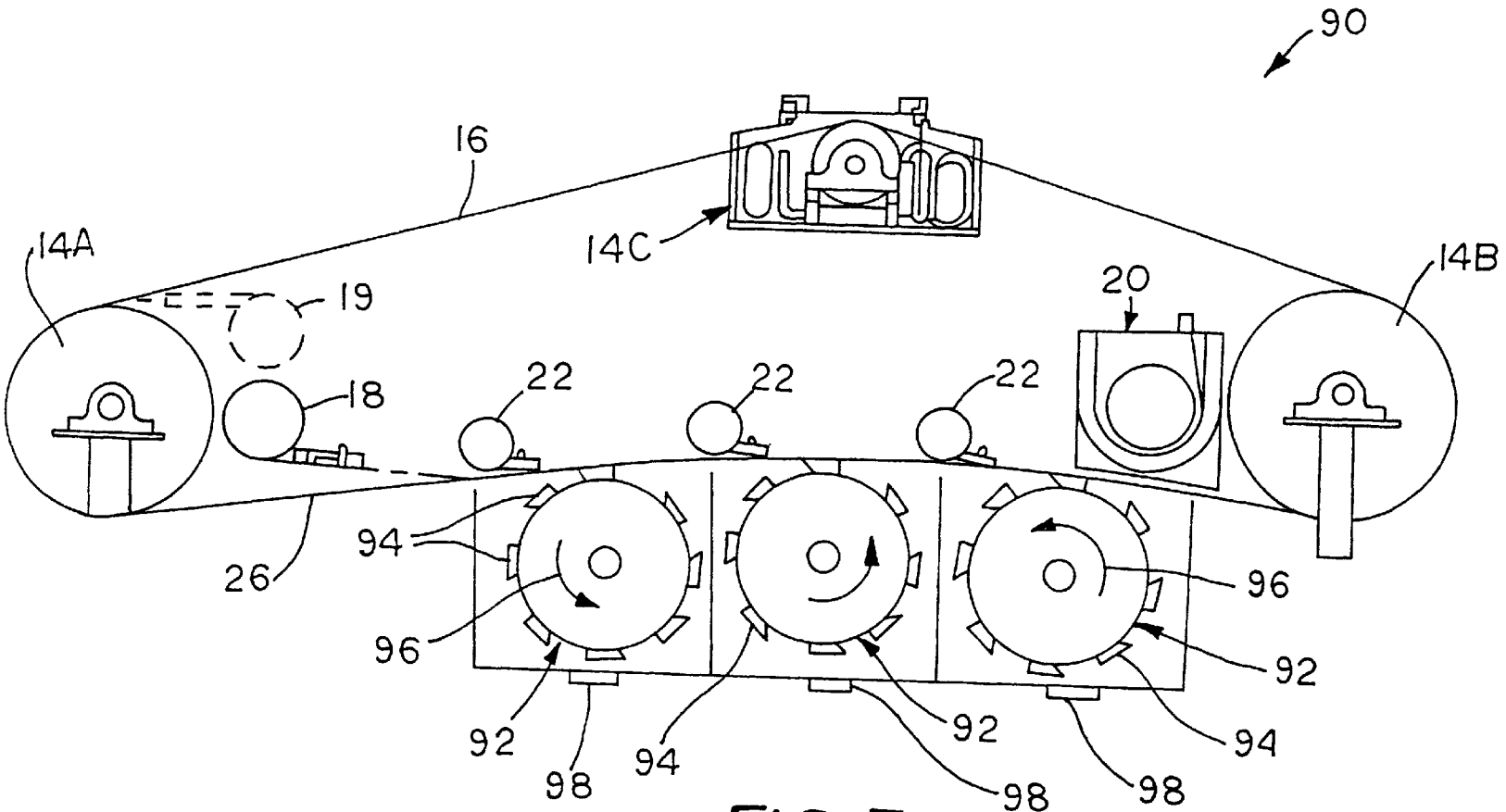
FIG. 3 illustrates yet another embodiment of a washer of the present invention.

FIG. 3 illustrates yet another embodiment of a washer 90 of the present invention. Washer 90 includes a headbox 18, showers 22 and an accept removal device 20 similar to the embodiment of washer 10 shown in FIG. 1A. Washer 90 principally differs from washer 10 and washer 80 through the use of a plurality of dewatering elements 24 in the form of foil rolls. Each foil roll 92 includes a plurality of foils 94 carried on the periphery thereof which extend the working width of porous fabric 16. Foil rolls 92 each rotate in a direction opposite to running direction 30 of porous fabric 16, as indicated by rotational arrow 96. A drainage pan 98 is positioned under and in association with each foil roll 92. Drainage pans 98 and showers 22 are fluidly coupled with effluent tank 8 as described above with reference to washer 10. Operation of washer 90 is substantially similar to the operation of washer 10 described above, and thus will not be described in further detail.

In the embodiment of washers 10, 80 and 90 described above, respective drainage pans 44, 84 and 98 include an open top which is exposed to ambient pressure, and thus have an ambient pressure therein. However, it is also possible and within the scope of this invention to provide a vacuum within drainage pans 44, 84 and/or 98 to further assist in dewatering of the fiber suspension.

While this invention has been described as having a preferred design, the present invention can be further modified within the spirit and scope of this disclosure. This application is therefore intended to cover any variations, uses, or adaptations of the invention using its general principles. Further, this application is intended to cover such departures from the present disclosure as come within known or customary practice in the art to which this invention pertains and which fall within the limits of the appended claims.

What is claimed is:

1. A washer for washing a fiber suspension associated with a fiber stock preparation system, said washer consisting essentially of:

a plurality of rolls;

a porous fabric carried by said plurality of rolls in a closed loop, said closed loop including a lower run defining a washing zone, said porous fabric moving in a running direction through said washing zone, said porous fabric having an upper surface in said washing zone for carrying the fiber suspension thereon;

a headbox positioned within said closed loop and above said porous fabric at an upstream end of said washing zone, said headbox configured for discharging a fiber suspension to be washed onto said upper surface of said porous fabric;

an accept removal device positioned within said closed loop and above said porous fabric at a downstream end of said washing zone, said accept removal device being configured for actively removing the fiber suspension from said upper surface of said porous fabric;

a plurality of showers positioned within said closed loop and above said porous fabric in said washing zone between said headbox and said accept removal device; and a plurality of dewatering elements positioned below said porous fabric in said washing zone, each said dewatering element being configured for removing water from a bottom surface of said porous fabric.

2. The washer of claim 1, further comprising:

an effluent tank having a plurality of compartments, each said compartment having an inlet; and a plurality of drainage pans positioned below said lower run of said porous fabric, each said drainage pan being associated with at least one said dewatering element and having an outlet, each said outlet connected with a corresponding inlet of said effluent tank.

3. The washer of claim 2, wherein each said shower has an inlet and each said compartment of said effluent tank has an outlet, at least one said effluent tank outlet being connected with a corresponding said shower inlet.

4. The washer of claim 3, wherein an upstream one of said effluent tank compartments is connected with an upstream one of said shower inlets.

5. The washer of claim 4, wherein a downstream one of said shower inlets receives fresh water.

6. The washer of claim 3, wherein said effluent tank comprises a flotation-type effluent tank.

7. The washer of claim 3, wherein said plurality of drainage pans are sequentially arranged along said lower run of said porous fabric.

8. The washer of claim 7, wherein said plurality of dewatering elements include a plurality of table rolls, and wherein each said drainage pan is associated with a corresponding one of said table rolls.

9. The washer of claim 2, wherein said plurality of drainage pans have a vacuum applied therein.

10. The washer of claim 1, wherein at least one of said showers includes at least one adjustable discharge nozzle.

11. The washer of claim 1, wherein said accept removal device comprises a box having an open end positioned closely adjacent said upper surface, and a screw conveyor leading from said box.

12. The washer of claim 1, wherein said porous fabric comprises a wire.

13. The washer of claim 1, wherein each said dewatering element comprises one of a foil and a table roll.

14. The washer of claim 1, wherein each said dewatering element comprises a foil roll.

15. The washer of claim 1, wherein said washer is positioned one of within and downstream from the fiber stock preparation system.

16. The washer of claim 1, wherein said accept removal device is comprised of at least one of a scraper, a foil and an enclosure with a vacuum applied thereto.

17. A washer system for washing a fiber suspension associated with a fiber stock preparation system, said washer consisting essentially of:

a plurality of rolls;

a porous fabric carried by said plurality of rolls in a closed loop, said closed loop including a lower run defining a washing zone, said porous fabric moving in a running direction through said washing zone, said porous fabric having an upper surface in said washing zone for carrying the fiber suspension thereon;

a headbox positioned within said closed loop and above said porous fabric at an upstream end of said washing zone, said headbox configured for discharging a fiber suspension to be washed onto said upper surface of said porous fabric;

an accept removal device positioned within said closed loop and above said porous fabric at a downstream end of said washing zone, said accept removal device being configured for actively removing the fiber suspension from said upper surface of said porous fabric;

a plurality of showers positioned within said closed loop and above said porous fabric in said washing zone between said headbox and said accept removal device, each said shower having an inlet;

a plurality of dewatering elements positioned below said porous fabric in said washing zone, each said dewatering element being configured for removing water from a bottom surface of said porous fabric;

an effluent tank having a plurality of compartments, each said compartment having an inlet and an outlet, at least one said effluent tank outlet being connected with a corresponding said shower inlet; and a plurality of drainage pans positioned below said lower run of said porous fabric, each said drainage pan being associated with at least one said dewatering element and having an outlet, each said drainage pan outlet connected with a corresponding said effluent tank inlet.

18. The washer of claim 17, wherein an upstream one of said effluent tank compartments is connected with an upstream one of said shower inlets.

19. The washer of claim 18, wherein a downstream one of said shower inlets receives fresh water.

20. The washer of claim 17, wherein said plurality of dewatering elements include a plurality of table rolls, and wherein each said drainage pan is associated with a corresponding one of said table rolls.

21. The washer of claim 17, wherein said accept removal device comprises a box having an open end positioned closely adjacent said upper surface, and a screw conveyor leading from said box.

22. The washer of claim 16, wherein said plurality of drainage pans have a vacuum applied therein.

23. The washer of claim 17, wherein said accept removal device is comprised of at least one of a scraper, a foil and an enclosure with a vacuum applied thereto.

* * * * *